US008900716B2

(12) United States Patent
Hodges et al.

(10) Patent No.: US 8,900,716 B2
(45) Date of Patent: Dec. 2, 2014

(54) ANTIMICROBIAL ANODIZED ALUMINUM AND RELATED METHOD

(75) Inventors: Lance W. Hodges, Whitehall, MI (US); Thomas R. Achterhoff, Norton Shores, MI (US); Kevin H. Darcy, North Muskegon, MI (US); James A. Nalewick, Whitehall, MI (US)

(73) Assignee: Lorin Industries, Inc., Muskegon, MI (US)

( * ) Notice: Subject to any disclaimer, the term of this patent is extended or adjusted under 35 U.S.C. 154(b) by 719 days.

(21) Appl. No.: 12/368,727

(22) Filed: Feb. 10, 2009

(65) Prior Publication Data

US 2009/0202845 A1 Aug. 13, 2009

Related U.S. Application Data

(60) Provisional application No. 61/027,505, filed on Feb. 11, 2008.

(51) Int. Cl.
*C25D 11/24* (2006.01)
*C23C 18/12* (2006.01)

(52) U.S. Cl.
CPC ..... *C25D 11/24* (2013.01); *C25D 11/246* (2013.01); *C23C 18/122* (2013.01); *C23C 18/1245* (2013.01)
USPC ..... 428/447; 205/223; 205/203; 205/315

(58) Field of Classification Search
None
See application file for complete search history.

(56) References Cited

U.S. PATENT DOCUMENTS 3,850,762 A * 11/1974 Smith ..... 205/75
4,065,364 A 12/1977 Fromson
5,008,789 A * 4/1991 Arai et al. ..... 362/255
5,753,322 A * 5/1998 Yamaguchi et al. ..... 428/14
5,851,373 A 12/1998 Kubota et al.
2003/0021721 A1* 1/2003 Hall ..... 422/4
2003/0196960 A1* 10/2003 Hughes ..... 210/670
2005/0008613 A1* 1/2005 Peterson et al. ..... 424/78.27
2008/0032121 A1* 2/2008 Lawlor ..... 428/335
2009/0202845 A1 8/2009 Hodges et al.
2010/0282083 A1* 11/2010 Edwards ..... 95/285

FOREIGN PATENT DOCUMENTS

JP 06312477 A * 11/1994 ..... B23B 7/00

OTHER PUBLICATIONS

JP 06312477 A English Machine Translation retreived from JPO from 1994.*
Davis, J.R. article pp. 102-107—Maney Publishing (2001).*
International Search Report; Mar. 23, 2012.
Office Action from Co-Pending U.S. Appl. No. 13/292,250; Dec. 18, 2013; USPTO.

* cited by examiner

*Primary Examiner* — Kenneth Stachel
(74) *Attorney, Agent, or Firm* — Barnes & Thornburg LLP

(57) ABSTRACT

An anodized aluminum product in continuous web or sheet form, which is heat sealed and coated with an antimicrobial composition. The antimicrobial coating can be bound to surface of the anodic layer and can comprise a network of cross-linked organo-silane molecules that are also covalently bound to the surface of the anodic layer. A process also is provided including: forming an anodic layer on the surface of an aluminum substrate; heat sealing the anodic layer; preheating the web or sheet to a range from about 140° F. to about 200° F.; applying an antimicrobial composition at an application rate sufficient for the composition to at least begin binding to the surface of and form an antimicrobial coating over the anodic layer; and post heating the coated anodized antimicrobial web or sheet to a range from about 140° F. to about 200° F. to further bind the composition to the cure the antimicrobial coating.

2 Claims, 4 Drawing Sheets

ANTIMICROBIAL ANODIZED ALUMINUM AND RELATED METHOD

This application claims priority to U.S. Provisional Application Ser. No. 61/027,505 that was filed on Feb. 11, 2008 and is incorporated by reference herein.

BACKGROUND

The present disclosure relates to a continuous web or sheet of anodized aluminum including an improved coating and a method for manufacturing the same.

Anodized aluminum is used in a variety of architectural applications. For example, due to its corrosion and weather resistance, anodized aluminum sheets are used on building exteriors. Anodized aluminum sheets also are used in interior architectural applications. Interior architectural components such as walls, back splashes, partitions, door knobs and table tops can be manufactured from sheets of anodized aluminum.

A problem with anodized aluminum sheets is that the surfaces of the sheets are highly hydrophilic. Therefore, water-born microbes and pathogens frequently become joined with the architectural anodized aluminum sheets. This can become problematic because installed interior architectural sheets are touched or contacted by many different people. In cases where the anodized aluminum sheet is infrequently washed, and where microbes and pathogens are given the opportunity to grow on the surface of the anodized aluminum, the anodized aluminum sheet can become a transfer agent for those microbes and pathogens. This can lead to an unnecessary health hazard.

SUMMARY

The aforementioned problems are overcome by an anodized aluminum product in continuous web or sheet form, which is heat sealed and coated with an antimicrobial composition.

In one embodiment, the antimicrobial composition is organo-silane based. Optionally the organo-silane is 3-(trimethoxysilyl)propyldimethyloctadecyl ammonium chloride.

The present disclosure also provides a method for producing an antimicrobial anodized aluminum product in continuous web or sheet form including: forming an anodic layer on the surface of an aluminum substrate by anodically coating an aluminum core in an electrolyte solution; heat sealing the anodic layer with a heated solution of water; preheating the web or sheet to a range from about 140° F. to about 200° F.; applying an antimicrobial composition at an application rate sufficient for the composition to at least begin binding to the surface of and form an antimicrobial coating over the anodic layer; and post heating the coated anodized antimicrobial web or sheet to a range from about 140° F. to about 200° F. to further bind the composition to the cure the antimicrobial coating.

In another embodiment, after heat sealing of the anodic layer, the anodic layer may be etched with an etching composition, to enable the subsequently applied antimicrobial coating to better join with the remaining portion of the anodic layer. The etching composition, optionally in a solution form, may be applied to the web or sheet in a variety of manners, for example: by cascading the etching solution over the web or sheet; by misting the etching solution over the web or sheet; by spraying the etching solution on the web or sheet; by dipping the web or sheet in the etching solution; and/or by rolling or brushing the etching solution on the web or sheet.

Further optionally, heat or temperature regulated air flow may be applied on the web or sheet to affect the etching process.

The present disclosure provides a continuous web or sheet of anodized aluminum including an antimicrobial coating that inhibits or prevents the growth of microbes such as bacteria, mold, mildew, algae, fungi and yeast. When the continuous web or sheet is used to manufacture architectural materials and/or components that are frequently contacted by various users, it can reduce the spread of microbes, particularly pathogenic microbes, among those users.

These and other objects, advantages and features of the disclosure will be more readily understood and appreciated by reference to the detailed description of the disclosure and the drawings.

DETAILED DESCRIPTION OF THE DISCLOSURE

I. Construction

The antimicrobial anodized aluminum product of the present disclosure includes a continuous web (e.g., a substantial length of aluminum that can be pulled through multiple processing stations) or sheet having an anodic layer on one or both sides of the web or sheet.

To produce the anodic layer, a continuous web of raw aluminum core 70 is provided and subjected to an electrolytic solution and anodizing environment. A variety of acids, such as sulfuric acid, oxalic acid, chromic acid, organic acid and/or phosphoric acid can be used to form the anodic layer. The thickness of the anodic layer after anodizing can be about 0 mils to about 0.400 mils, and preferably about 0.175 mils.

The anodic coating (aluminum oxide or $Al_2O_3$) layer 50 formed during anodizing is porous. There are narrow holes in the aluminum oxide layer that are about 100 Angstroms in diameter that extend from the top of a pore to the bottom of the pore. When the web including the anodic coating is placed in a bath of boiling water (e.g., in the sealing station 6), water absorbs into the aluminum oxide, which in turn swells the aluminum oxide layer, substantially closing the pores. There also is a chemical reaction between the aluminum oxide and water, such that $Al_2O_3$+H2O form a structure, 2*AlO(OH), which is called Bomite. The part of the aluminum oxide that has been converted to Bomite has less density than the part of the aluminum oxide layer that has not been hydrated by the water.

Figure 2:
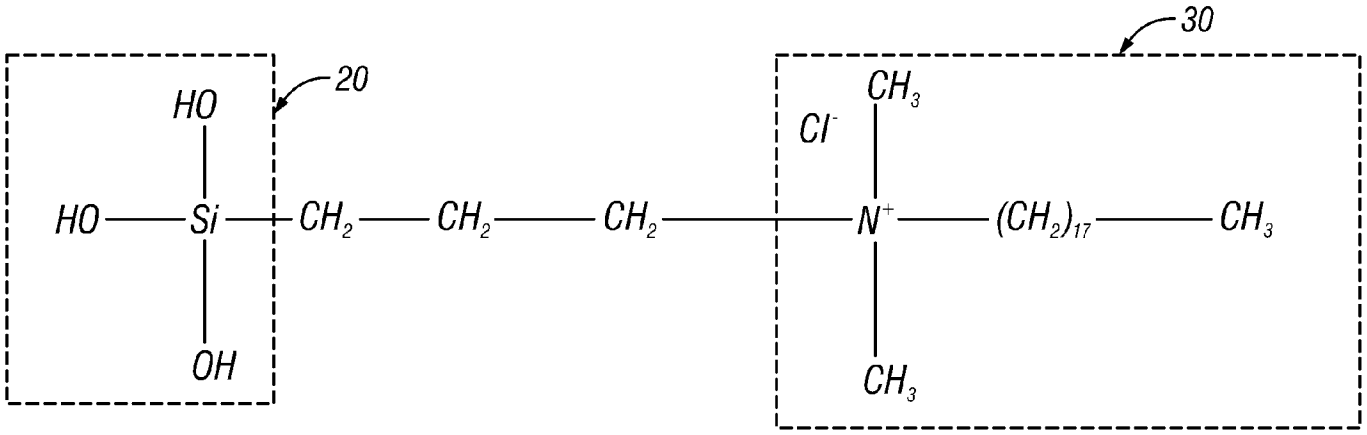
FIG. 2 is a diagram of an antimicrobial composition suitable for use with the present disclosure.
Figure 3:
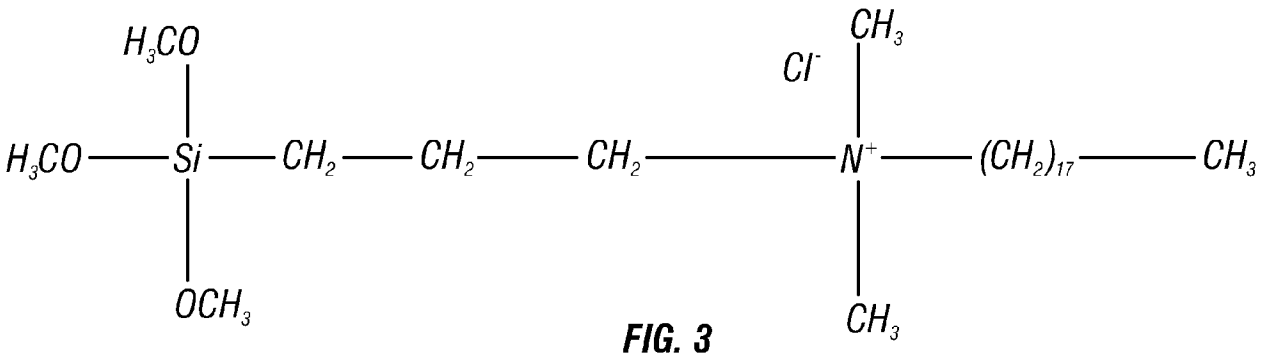
FIG. 3 is a diagram of the antimicrobial composition in another form.

The antimicrobial composition joined with the anodized layer can be a metal, such as silver, copper, and/or zinc that is coated and bound to the anodic layer. Other suitable antimicrobial compositions are organo-silanes. A suitable organo-silane, which is water based, is 3-(trimethoxysilyl)propyldimethyl-octadecyl ammonium chloride), which is commercially available from Nova BioGenetics, Inc., of Atlanta, Ga., under the trade name BST AM500, and also commercially available from Aegis Environments of Midland, Mich. under the trade name Aegis Microbe Shield® AEM 5772 or AEM 5700. Organo-silanes that are similar in composition to those available through Nova BioGenetics and Aegis can also be used. The empirical formula for this compound is $C_{26}H_{58}Cl\,N\,03\,Si$, and the molecular weight is 496.29. The structure of this organo-silane, shown as an active ingredient in a dilute aqueous solution such as water or methanol, is illustrated in FIG. 2. The structure of this organo-silane, shown as an active ingredient in a concentrate, is illustrated in FIG. 3.

With reference to FIG. 2, the organo-silane includes both a cross-linking or binding head 20 and a microbe inhibiting/destroying tail 30. The tail 30 is capable of inhibiting/destroying a variety of microbes, for example, bacteria, such as *Escherichia* coil and *Staphylococcus aureus*, as well as mold, mildew, algae, fungi and yeast.

The organo-silane of the present disclosure is used to form a coating on the treated anodic layer 60 of the continuous web or sheet of anodized aluminum. Specifically, with reference to FIG. 4, the organo-silane head 20 performs two functions. In one, it attaches the surface of the treated anodic layer 60 via short range Van der Waals and/or hydrogen bonding forces. In another, the head of one organo-silane molecule (a silanol group) reacts with another silanol group of an adjacent organo-silane molecule and cross-links with it.

When applied to the treated anodic layer 60 in mass quantity, multiple organo-silane silanol groups react and bind together and to the anodic layer 60. Where other hydroxyl, amine or other substrate groups are present, the organo-silane molecule can join directly with those molecules or substrates as well. After the head 20 of each molecule binds to the anodic coating, the antimicrobial head 30 remains exposed to form a nanocoating of the organo-silane antimicrobial on the surface of the anodic layer. This antimicrobial nanocoating can be of a depth from about 10 micrometers to about 40 micrometers, and preferably about 20 micrometers.

II. Method of Manufacture

Figure 1:
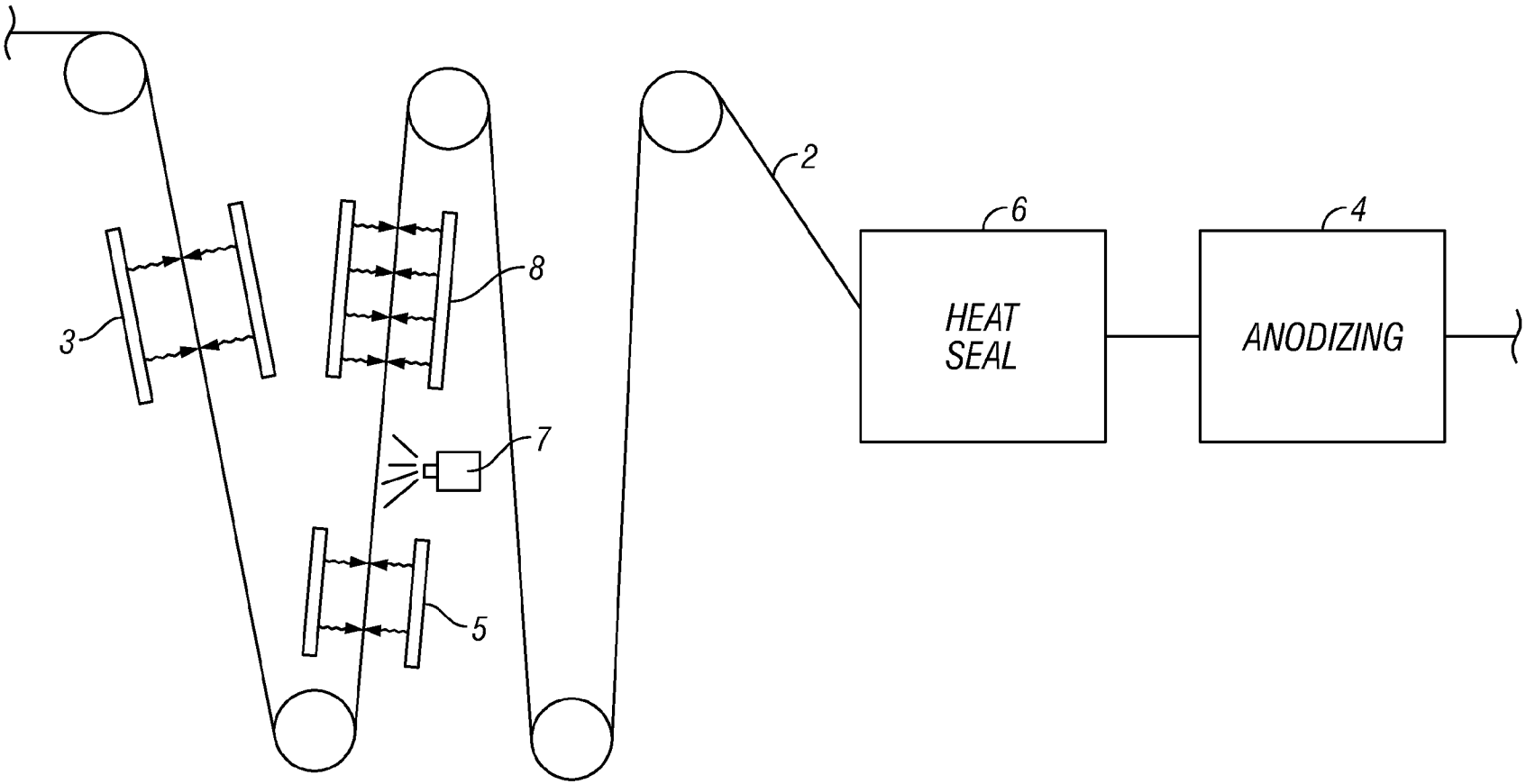
FIG. 1 is a schematic view of a process for manufacturing an antimicrobial anodized aluminum continuous web of the present disclosure.
Figure 4:
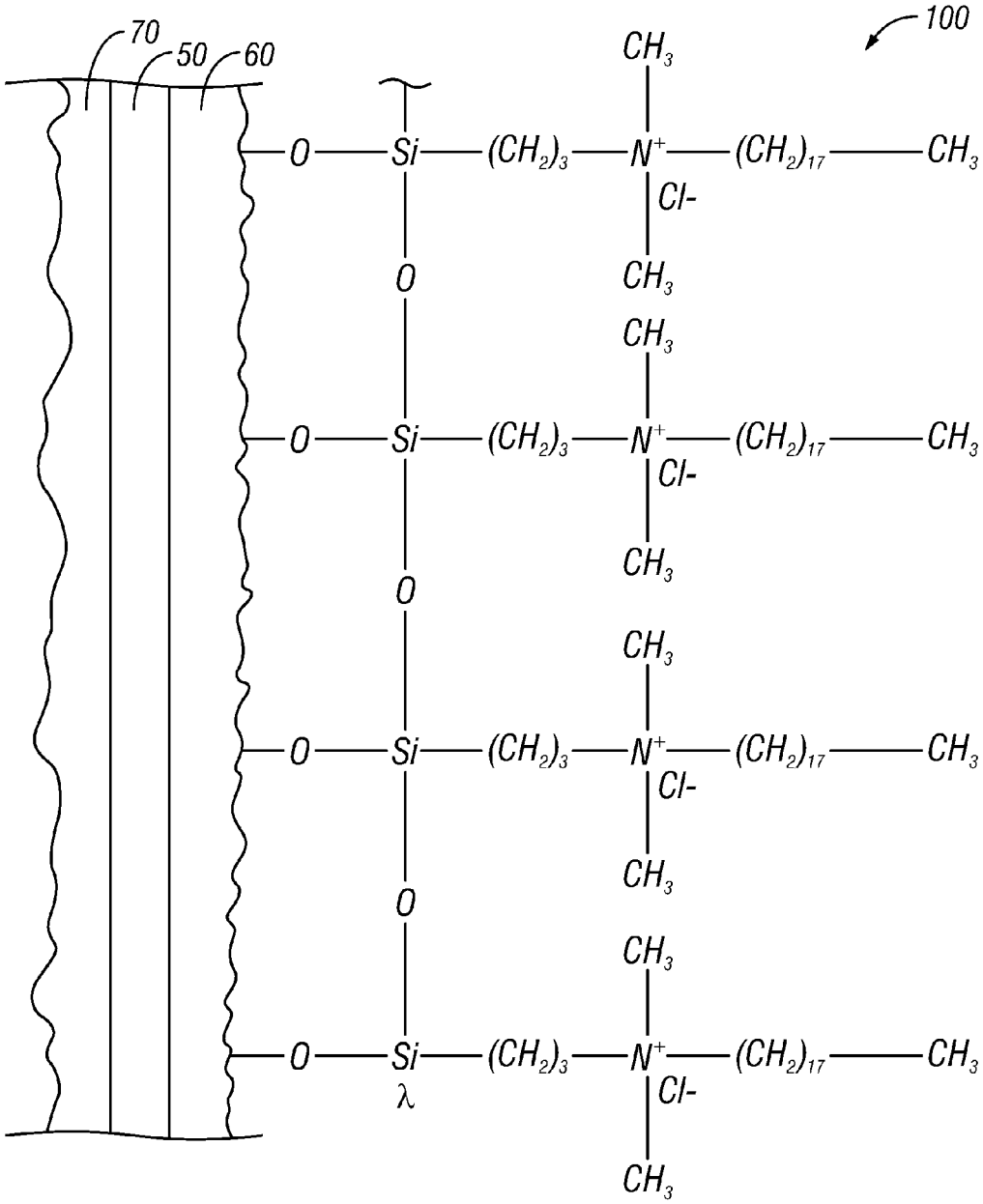
FIG. 4 is a view of the antimicrobial composition bound to an anodic layer of a continuous web of anodized aluminum.

A method for producing an antimicrobial anodized aluminum product in continuous web or sheet form will now be described with reference to FIGS. 1 and 4. With reference to FIG. 1, a continuous raw aluminum or aluminum alloy core web is introduced to the anodizing station 4 where it is anodicly polarized in an electrolyte solution to form the anodic layer. The web 2 continues to station 6 where it is heat sealed in a solution of hot water, at a temperature of about 205° F.

After the continuous web 2 is heat sealed, it continues to preheating station 8. At this station, the web is heat treated to a range from about 140° F. to about 200° F., preferably about 180° F. Before this heat treatment, the temperature of the web is about 115° F. The heaters are stationed about 4 inches to about 10 inches from the web, preferably about 6 inches from the web, to exert the appropriate amount of heat to elevate the temperature of the surface of the web to the aforementioned ranges. A suitable heater is a Chromalox ® S-RAD single element radiant heater, which is available from Chromalox, Inc. of Pittsburgh, Pa. Although shown with heaters on both sides of the web, one set of heaters (opposite the misted side of the web) optionally can be deleted from stations 5 and 8.

After the web 2 is preheated, it continues on to pass the misters 7, which mist a coating of antimicrobial composition onto the surface of the anodic layer of the web 2 on one side of the web. Optionally, both sides of the web may be misted as the application requires. The web passes the misters at a speed from about 10 feet per minute to about 50 feet per minute, preferably about 25 feet per minute. The misters can be spaced about 3 inches to about 10 inches, preferably about 7 inches away from the web. The misters can also be spaced about 6 inches to about 10 inches from one another (beside one another, across the web), and preferably about 8 inches from one another.

The antimicrobial composition supplied through the mister can include the organo-silane described above. That organo-silane can be diluted before being applied by the misters. Specifically, the mixture of the antimicrobial composition can be about 3% to about 10%, preferably 3.4% to 6.8% and further preferably about 6.8% by volume Aegis AEM 5700; about 0.001% to about 2%, preferably about 0.1% by volume Dow Corning Q2-5211 Superwetting Agent (commercially available from Dow Coming Corporation of Midland, Mich.); and about 90% to about 99%, preferably about 93.1% high purity RO water.

The antimicrobial composition can be applied through the misters at about 4 psi with an application from about 0.1 milliliters to about 0.8 milliliters, preferably about 0.3 milliliters, per nozzle per square foot of the continuous web 2. The total application rate for all the nozzles on the continuous web is a range from about 1.5 milliliters to about 2.5 milliliters per square foot of the web. As noted above, when the antimicrobial composition is organo-silane and it is applied to the surface of the web, it hydrogen bonds to the surface of the anodic layer, and the heads of the organo-silane cross-link to one another. FIG. 4 illustrates on a molecular level the interaction of the organo-silane molecules with one another and the anodic layer to form an antimicrobial nanocoating on the anodic layer.

After the antimicrobial composition is sprayed to one side of the web, the continuous web 2 passes a first post-heating station 5. This station can apply heat to the web to keep the temperature of the web an elevated range from about 140° F. to about 200° F., preferably about 180° F. At or near this station, the aqueous carrier, for example the water and methanol, begin to evaporate. Depending on the application rate, a third post-treatment heater 3 can be included in the system to further evaporate the water from the web and/or other volatile carriers from the antimicrobial composition.

The continuous web, now coated with an antimicrobial coating as described above, can be processed using conventional techniques, and rolled or cut for further distribution.

EXAMPLE 1

An example of preparing a antimicrobial composition and applying it to a continuous web of anodized aluminum will now be described.

An antimicrobial composition was prepared by adding 1285 milliliters of the organo-silane Aegis AEM 5700 to an aqueous carrier having 17696 milliliters of RO water and 19 milliliters of Dow Corning Q2-5211 Superwetting agent to produce the resulting antimicrobial composition. The resulting antimicrobial composition was placed in liquid communication with the mister station 7.

Next, a continuous web 2 was anodized and heat sealed. The surfaces of the web 2 were heated to approximately 180° F. at preheating station 8. The anodized web 2 was fed past the antimicrobial treatment station 7 at a rate of about 25 feet per minute. The misters applied 2 milliliters per square foot of the antimicrobial solution to the passing web 2. The passing web was subjected to a post-heating at station 5 where the web was heated again to about 180° F., where substantially all of the water and methanol were evaporated off the web 2, and substantially all of the organo-silane remained to form an antimicrobial nanocoating over the anodic layer 60. Further post-treatment heating was performed at station 3.

A sample of the completed web 2 was then tested for its antimicrobial properties. Specifically, the sample was subjected to JIS 2801-2000: Static Surface contact: Japanese Industrial Standard: Antimicrobial products—Test for antimicrobial activity and efficacy and ASTM E2149-01, "Standard Test Method for Determining the Antimicrobial Activity of Immobilized Antimicrobial Agents Under Dynamic Contact Conditions," ASTM International, which are hereby incorporated by reference. The results of the test on the sample produced in this example indicated a 99.99% reduction in *staphlococcus aureus*, which indicated that the antimicrobial anodized aluminum product of the present disclosure had exceptional antimicrobial properties.

I. First Alternative Embodiment

An alternative embodiment of the present disclosure will now be described. In this alternative embodiment, after the continuous web 2 is heat sealed, and before it continues to preheating station 8, it is subjected to an etching composition that lightly etches the sealed, anodic layer. "Etching" is a chemical treatment whereby an etching composition is applied to and partially or fully dissolves or removes a sealed layer or an anodic film or layer on an anodized aluminum surface to create a roughened morphology. An "etching composition" can be any alkaline or acidic media capable of dissolving or removing all or a portion of aluminum oxide to a substantial degree, including but not limited to sodium hydroxide, calcium hydroxide, phosphoric acid, hydrofluoric acid, sulfuric acid, bromic acid and chromic acid.

A "roughened morphology" refers to a condition where the heat sealed layer or anodic film of the anodized aluminum includes an extended or protruded surface area, which provides many sites for an increased number of mechanical—and in some cases chemical-bonds between the heat sealed layer or the anodic layer and an antimicrobial composition applied over the heat sealed layer and/or anodic film. The roughened morphology may resemble the surfaces depicted in FIGS. 1 and 2, or other configurations depending on the etching solution applied, the duration of application and the temperature.

The etching composition may be a solution of water or other suitable liquid mixed with an alkaline, acidic or other caustic material, capable of dissolving and or removing the heat sealed layer and/or aluminum oxide layer. One etching solution is a solution of sodium hydroxide from about 0.1 to about 0.5 molar. Optionally, sodium hydroxide solutions from about 0.5 to about 1.5 molar, and 1.0 to about 4 molar may also be used. Alternatively, the etching solution may be a solution of phosphoric acid in concentrations of optionally about 0.1 to about 5.1 molar, further preferably about 0.5 to about 3.0 molar and even further preferably about 0.75 to about 1.5 molar. Solutions of sulfuric acid may also be used, however, the temperature and duration of time required to sufficiently dissolve an aluminum oxide layer must be significantly increased relative to the temperature and duration required with sodium hydroxide solutions and phosphoric acid solutions.

The pre-etched heat sealed layer and anodic layer can be greater than 0.1 mils (thousandths of an inch) or about 2.54 microns in depth. Due to the etching, at least a portion of the heat sealed layer and the anodic layer are removed so that a newly created bonding layer remains, where that bonding layer includes a roughened morphology. In this morphology, the bonding layer may be about 1 to about 20 nanometers, preferably 2 to about 10 nanometers, and most preferably about 5 to about 6 nanometers in depth. Of course, the bonding layer can be of lesser proportions as desired, for example, only 5%, 10%, 20%, 30% and/or 40% of the above noted depths, depending on the desired bonding of the antimicrobial composition to the remaining portion of the heat sealed and/or anodic layers. Other roughened morphologies that increase the potential for mechanical interlocking of the antimicrobial composition to the heat sealed and/or anodic layer can be used as desired, for example, those explained in U.S. Pat. No. 7,029,597 to Marzak, filed Jul. 5, 2001, which is hereby incorporated by reference in its entirety.

After the etching composition is applied to the web or sheet, and the desired bonding layer created, the web or sheet can be pre-heated at station 8, and processed as set forth in the embodiment above to apply the antimicrobial composition as desired.

EXAMPLE 2

Another example of preparing a antimicrobial composition and applying it to a continuous web of anodized aluminum will now be described.

An antimicrobial composition was prepared by adding 136 milliliters of the organo-silane Aegis AEM 5700 to an aqueous carrier having 1864 milliliters of RO water to produce the resulting antimicrobial composition. The resulting antimicrobial solution was placed in allowed to hydrolyze for one hour, and was heated to 210 F. before samples were immersed in the solution.

A web of aluminum was anodized and heat sealed. Thereafter, the web was etched to remove at least a portion of the heat sealed layer and the anodic layer of the web. The etching was performed with a solution of 0.15M molar sodium hydroxide, at a temperature of about 80° F., rolled onto the web, and left in contact with the web for about 2 seconds before the solution was rinsed from the web. It is believed that the etching composition created a bonding layer of about 2 microns. Thereafter, one 4 inch×6 inch sample was removed from the web.

The sample was individually immersed in the antimicrobial solution for about five minutes. Then the sample was rinsed with RO water and air dried. It is believed that substantially all of the organo-silane remained to form an antimicrobial nanocoating over the bonding layer. Further, it is believed that this nanocoating should be sufficiently bonded to the bonding layer so that the resulting sample can withstand further processing, such as stamping, bending, and other physical modification, without the antimicrobial nanocoating flaking off from, or otherwise disengaging, the sample to preserve the antimicrobial properties of the sample.

IV. Second Alternative Embodiment

Various other processing techniques are being tested to produce a bonding layer to which the antimicrobial composition can join, and remain joined upon further physical modification of the web or sheet. Several of these processing techniques are described below. In the first four techniques, an antimicrobial composition was prepared by adding 136 milliliters of the organo-silane Aegis AEM 5700 to an aqueous carrier having 1864 milliliters of RO water to produce the resulting antimicrobial composition. The resulting antimicrobial solution was allowed to hydrolyze for one hour, and was heated to 210° F. before samples were immersed in the solution.

In the first technique, two samples of raw ClearMatt, available from Lorin Industries of Muskegon, Mich., and two samples of Alumaplus raw metal, also available from Lorin Industries, were cleaned with phosphoric acid at a concentration of 4.5% for one minute each, then rinsed with RO water.

Next, the samples were caustic etched with sodium hydroxide at a concentration of 38 g/l for one minute each, then rinsed with RO water, and then dipped in the antimicrobial solution for five minutes to coat the surfaces of the samples with an antimicrobial coating.

In the second technique, two samples of ClearMatt, available from Lorin Industries, were cleaned for one minute, rinsed, caustic etched with sodium hydroxide at a concentration of 38 g/l for one minute, rinsed again, desmutted with nitric acid at a concentration of 8% for 15 seconds, anodized for 2.5 minutes with 12 amps, rinsed yet again, and dried. The samples were then dipped in the antimicrobial solution for five minutes to coat the surfaces of the samples with an antimicrobial coating.

In the third technique, two samples of ClearMatt were cleaned, immersed in phosphoric acid at a concentration of 30% for four minutes. The samples were then dipped in the antimicrobial solution for five minutes to coat the surfaces of the samples with an antimicrobial coating. Two Alumaplus raw metal finish samples were also processed using the same techniques.

In the fourth technique, two samples of Alumaplus, available from Lorin Industries, were anodized after being cleaned for one minute in phosphoric acid at a concentration of 4.5% and bright dipped in nitric acid at a concentration of 3.5% for one minute. Then the samples were dipped in the Alumaplus dye tank, which includes Grey NLN from Specialty Dye and Bronze 2LW from Clariant, at a concentration of 0.8 g/l and 0.25 g/l, respectively, for one minute, then sealed with nickel and hot water. Two more samples followed the same processing steps, except for the sealing process of nickel and hot water. Four Clearmatt samples, available from Lorin Industries, were also processed in the same order. Two of these Clearmatt samples were sealed and two of them were not.

In a fifth technique, 1360 milliliters of AEM 5700 were added to a 20-liter dye tank, which already included a dye solution having 16 grams of Grey NLN dye and 5 grams of Bronze 2LW with the remaining volume being water. Two anodized samples were passed from the anodizing tank to, the dye tank, which included the Aegis chemistry. Then the samples were immersed into the nickel seal for one minute and the hot water seal for five minutes.

Figure 5:
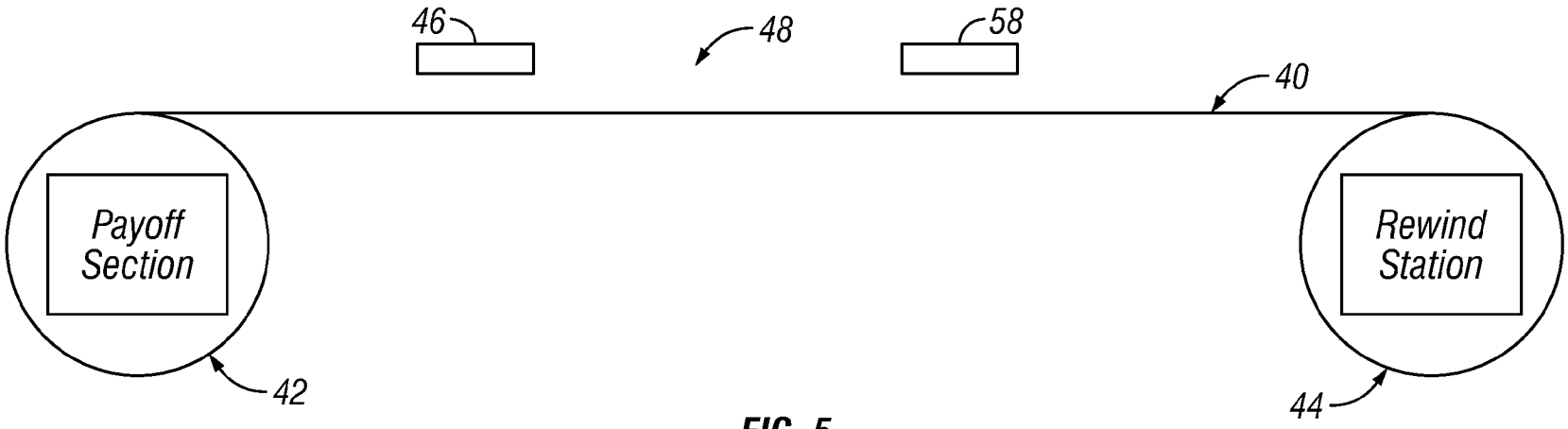
FIG. 5 is a schematic view of another process showing a pre-anodized coil product having an antimicrobial composition applied using secondary application equipment.

In another embodiment a continuous web or sheet of pre-anodized aluminum 40 is processed from a payoff spool 42 to a rewind spool 44, as shown, for example, in FIG. 5. During this process, the web of aluminum 40 is first heated by heaters at station 46 to a range from about 140° F. to about 200° F., preferably to about 180° F. The heaters are stationed about 8 inches to about 16 inches from the web, preferably about 12 inches from the web.

After the web 40 is preheated, the web is passed under the application point 48. Application may include up to two Nordson Rotary Atomizer guns applying antimicrobial solution at a rate from about 1 oz/min to about 4 oz/min. The web 40 passes the application point 48 at a speed from about 7 feet/min to about 90 feet/min, preferably at about 25 feet/min. The web 40 is next heated by a second set of heaters at station 58. This station can apply heat to the web 40 to keep the temperature of the web 40 an elevated range from about 140° F. to about 200° F., preferably about 180° F. The heaters are stationed about 8 inches to about 16 inches from the web, preferably about 12 inches from the web. At or near this station, the aqueous carrier, for example the water and methanol of the solution, begins to evaporate.

The above descriptions are those of the preferred embodiments of the disclosure. Various alterations and changes can be made without departing from the spirit and broader aspects of the disclosure as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to "at least one of X, Y and Z" refers to one or more of X, Y, or Z, but does not require that each of X, Y and Z be present.

The embodiments of the disclosure in which an exclusive property or privilege is claimed are defined as follows:

1. An anodized antimicrobial aluminum that resists the formation of microbes on the surface of the aluminum consisting of:

aluminum in a continuous web or sheet form;

an anodic layer positioned near a surface of the aluminum in the continuous web or sheet form;

a heat sealed anodic layer positioned to lie near the anodic layer; such that pores of the anodic layer are substantially closed;

organo-silane molecules bound to the surface of the heat sealed anodic layer wherein the organo-silane molecules are cross linked with adjacent organo-silane molecules to form an antimicrobial coating; and wherein the organo-silane molecules are 3-(trimethoxysilyl)propyldimethyloctadecyl ammonium chloride.

2. An anodized antimicrobial aluminum that resists the formation of microbes on the surface of the aluminum consisting of:

an aluminum substrate;

an anodic layer of aluminum oxide formed on a surface of the aluminum substrate;

wherein pores formed in the aluminum oxide have been substantially closed to form a sealed aluminum oxide layer over the anodic layer of aluminum oxide;

organo-silane molecules bound to the surface of the sealed aluminum oxide layer wherein the organo-silane molecules are cross linked with adjacent organo-silane molecules to form an antimicrobial coating;

wherein the organo-silane molecules are 3-(trimethoxysilyl)propyldimethyloctadecyl ammonium chloride.

* * * * *